US010385603B2

(12) United States Patent
Fletcher et al.

(10) Patent No.: US 10,385,603 B2
(45) Date of Patent: Aug. 20, 2019

(54) WINDOW LIFT MECHANISM

(71) Applicant: Parker-Hannifin Corporation, Cleveland, OH (US)

(72) Inventors: William K. Fletcher, Richmond, MI (US); Christopher R. Vargas, Jeannette, PA (US); Alexander M. Pankiw, Monroeville, PA (US); Michael D. Bridges, Monroeville, PA (US); Thomas J. Baric, Export, PA (US); Jeremiah K. Miller, North Huntington, PA (US); Andrew C. McClelland, Chardon, OH (US); Daniel H. Craft, Pittsburgh, PA (US)

(73) Assignee: Parker-Hannifin Corporation, Cleveland, OH (US)

( * ) Notice: Subject to any disclaimer, the term of this patent is extended or adjusted under 35 U.S.C. 154(b) by 158 days.

(21) Appl. No.: 15/594,894

(22) Filed: May 15, 2017

(65) Prior Publication Data

US 2017/0328111 A1 Nov. 16, 2017

Related U.S. Application Data

(60) Provisional application No. 62/335,992, filed on May 13, 2016.

(51) Int. Cl.
*E05F 11/40* (2006.01)
*E05F 15/697* (2015.01)

(52) U.S. Cl.
CPC ..... *E05F 11/405* (2013.01); *E05F 15/697* (2015.01); *E05Y 2800/122* (2013.01); *E05Y 2900/55* (2013.01)

(58) Field of Classification Search
CPC ..... E05F 11/405; E05F 11/445; E05F 11/423; E05F 15/689; E05F 15/697; B60J 1/17;
(Continued)

(56) References Cited

U.S. PATENT DOCUMENTS 2,124,037 A 7/1938 Lavigne
3,062,528 A * 11/1962 Martens ..... E05F 11/405 49/227

(Continued)

FOREIGN PATENT DOCUMENTS

CN 203879190 U 10/2014
CN 104890479 A 9/2015

(Continued)

*Primary Examiner* — Justin B Rephann
(74) *Attorney, Agent, or Firm* — Renner, Otto, Boisselle & Sklar, LLP

(57) ABSTRACT

A window positioning apparatus for a vehicle comprising a window panel, a frame in which the window panel is guided between a closed position closing a window opening in the frame and an open position opening the window opening, and a multi-stage telescoping screw actuator mechanism connected between the window panel and the frame, the actuator mechanism being extendible to move the window panel from its open position to its closed position and collapsible to move the window panel from its closed position to its open position. The multi-stage telescoping screw actuator mechanism includes a plurality of screw members of progressively decreasing diameter respectively telescopically disposed within a next adjacent screw member of larger diameter. The plurality of screw members includes a first stage screw member that is rotatably supported and axially constrained in a housing fixed with respect to the frame, a last stage screw member attached to the window panel, and at least one intermediate stage screw member, and each intermediate stage screw member has internal and external threads respectively for engaging external and internal threads on next adjacent screw members, such that rotation of the first stage screw member in a first direction relative to the last stage screw member will cause the intermediate and last stage screw members to extend telescopically along an extension axis from the first stage
(Continued)

screw member and rotation in a second direction opposite the first direction will cause the intermediate and last stage screw members to telescopically retract.

20 Claims, 9 Drawing Sheets

(58) Field of Classification Search
CPC ... F16H 25/20; F16H 25/2056; E05Y 2900/55
See application file for complete search history.

(56) References Cited

U.S. PATENT DOCUMENTS 3,882,964 A * 5/1975 Schellenberg ..... B66F 11/04 182/69.4
4,364,202 A 12/1982 Zavatkay
4,400,913 A 8/1983 Krantz et al.
4,448,392 A 5/1984 Ladewski
4,586,290 A 5/1986 Juechter
4,651,581 A * 3/1987 Svensson ..... B66F 3/10 74/89.35
5,012,613 A * 5/1991 Sekine ..... B60J 1/17 49/349
5,035,094 A * 7/1991 Legare ..... B63B 15/0083 343/903
5,123,629 A 6/1992 Takeuchi
5,282,593 A * 2/1994 Fast ..... A47B 9/04 108/147
5,349,475 A * 9/1994 Nomura ..... G02B 7/102 359/694
5,636,064 A * 6/1997 Nomura ..... G02B 7/102 359/694
5,659,810 A * 8/1997 Nomura ..... G02B 7/10 359/695
5,787,644 A 8/1998 Thomsen, Jr.
6,427,385 B1 8/2002 Fin
6,685,169 B2 2/2004 Shim
6,874,764 B2 4/2005 Drake, III
7,055,284 B2 6/2006 Napoli et al.
7,225,694 B2 * 6/2007 Said ..... F16H 25/20 74/89.35
7,797,882 B2 9/2010 Lubaway
7,861,462 B2 1/2011 Smith et al.
8,567,762 B2 10/2013 Venturini et al.
2004/0237409 A1 * 12/2004 Napoli ..... E05F 11/385 49/349

FOREIGN PATENT DOCUMENTS

CN 105019767 A 11/2015
EP 2801689 A1 11/2014

* cited by examiner

WINDOW LIFT MECHANISM

This application claims priority to U.S. Provisional Patent Application No. 62/335,992 filed May 13, 2016, which is hereby incorporated herein by reference in its entirety.

The present invention relates to vehicle doors with lift mechanisms for opening and closing a vehicle window, and, more generally, to lift mechanisms.

BACKGROUND OF THE INVENTION

Window lift mechanisms are used to raise and lower a glass panel out of and into a vehicle door cavity. In some vehicles such as military vehicles, the lift mechanisms must be capable of generating sufficient force needed to raise and lower relatively large and heavy glass panels.

SUMMARY OF THE INVENTION

The present invention provides a vehicle window positioning apparatus that is characterized by a multi-stage telescoping screw actuator mechanism that is connected between a window panel and a frame. The actuator mechanism can be extended many times its collapsed length, making it particularly suitable for use in vehicles that have large window panels that need to be moved a substantial distance between open and closed positions, particularly where little room exists below the bottom of an open window panel in a vehicle door. The actuator mechanism, while affording unique advantages when used in a vehicle window positioning apparatus, may have uses in other applications as well.

More particularly and according to one aspect of the invention, a vehicle window positioning apparatus comprises a window panel, a frame in which the window panel is guided between a closed position closing a window opening in the frame and an open position opening the window opening, and a multi-stage telescoping screw actuator mechanism connected between the window panel and the frame, the actuator mechanism being extendible to move the window panel from its open position to its closed position and collapsible to move the window panel from its closed position to its open position. The multi-stage telescoping screw actuator mechanism includes a plurality of screw members of progressively decreasing diameter respectively telescopically disposed within a next adjacent screw member of larger diameter. The plurality of screw members includes a first stage screw member that is rotatably supported and axially constrained in a housing fixed with respect to the frame, a last stage screw member attached to the window panel, and at least one intermediate stage screw member. Each intermediate stage screw member has internal and external threads respectively for engaging external and internal threads on next adjacent screw members, such that rotation of the first stage screw member in a first direction relative to the last stage screw member will cause the intermediate and last stage screw members to extend telescopically along an extension axis from the first stage screw member and rotation in a second direction opposite the first direction will cause the intermediate and last stage screw members to telescopically retract.

Embodiments of the invention may include one or more of the following additional features separately or in combination.

The multi-stage telescoping screw actuator mechanism may be located below the window panel and may have the extension axis oriented upright within the frame.

The frame may be a door frame and the window panel may include a glass panel.

The last stage screw member may be fixed to the window panel against rotation about the extension axis.

The last stage screw member may be connected to the window panel by a connection that can pivot about at least one pivot axis extending laterally with respect to the extension axis.

The connection may be a universal joint.

There may be more than one intermediate stage screw member.

According to another aspect of the invention, a multi-stage telescoping screw actuator mechanism comprises a plurality of screw members of progressively decreasing diameter respectively telescopically disposed within a next adjacent screw member of larger diameter. The plurality of screw members includes a first stage screw member that is rotatably supported and axially constrained in a housing, a last stage screw member, and a plurality of intermediate stage screw members. Each intermediate stage screw member has internal and external threads respectively for engaging external and internal threads on next adjacent screw members, such that rotation of the first stage screw member in a first direction relative to the last stage screw member will cause the intermediate and last stage screw members to extend telescopically along an extension axis from the first stage screw member and rotation in a second direction opposite the first direction will cause the intermediate and last stage screw members to telescopically retract.

Embodiments of the invention according to the aforesaid aspects of the invention may include one or more of the following additional features separately or in combination.

An expandable and collapsible shield, in particular a bellows, may surround the plurality of screw members.

The bellows may have one axial end attached, preferably by a clamp, to a distal end of the last stage screw member and an opposite axial end attached, preferably by a clamp, to a distal end of the first stage screw member.

The first stage screw member may be supported both radially and axially by a bearing in the housing, preferably a radial ball bearing.

The bearing may be located at a proximal end of the first stage screw member, and a second bearing, preferably a bushing, may be located in the housing at a distal end of the first stage screw member.

A drive may be provided for rotating the first stage screw member.

The drive may include a driven gear attached to the first stage screw member, a drive gear engaged with the driven gear, and at least one of a motor or hand crank coupled to the drive gear for rotating the drive gear.

The driven gear may have a hub including a socket for receiving either a drive shaft coupled to a motor or a drive shaft coupled to a hand crank.

The internal threads of each screw member may extend substantially less than length of the screw member, such as less than one quarter the length, of the screw member.

The first stage member may be tubular and may have a cylindrical tube wall provided with a counterbore at a distal end of the first stage member for receiving a tubular insert on which the internal thread of the first stage member is formed, and the tubular insert may be formed of a material, in particular bronze, that is more lubricious than the material, in particular steel, from which the tube wall is formed.

A mounting plated may be keyed against relative rotation to the end of the last stage screw member.

The following description and the annexed drawings set forth certain illustrative embodiments of the invention. These embodiments are indicative, however, of but a few of the various ways in which the principles of the invention may be employed. Other objects, advantages and novel features according to aspects of the invention will become apparent from the following detailed description when considered in conjunction with the drawings.

DETAILED DESCRIPTION

Figure 1:
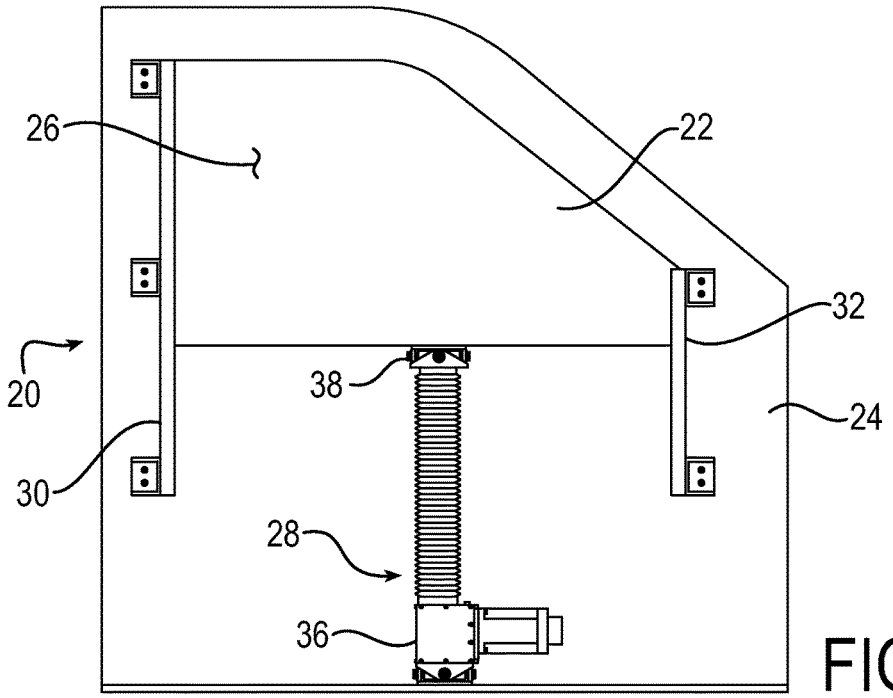
FIG. 1 is a front elevational view of a vehicle door including an exemplary window positioning apparatus according to the invention, with a window panel being shown in a closed position.
Figure 2:
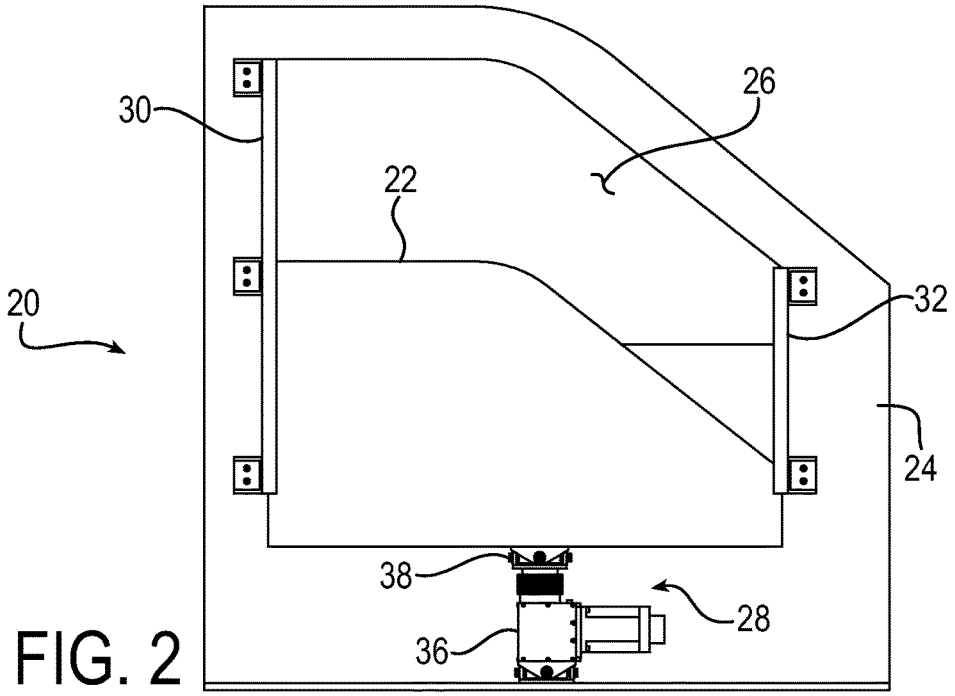
FIG. 2 is a front elevation view similar to FIG. 1, but showing the window panel in an open position.
Figure 3:
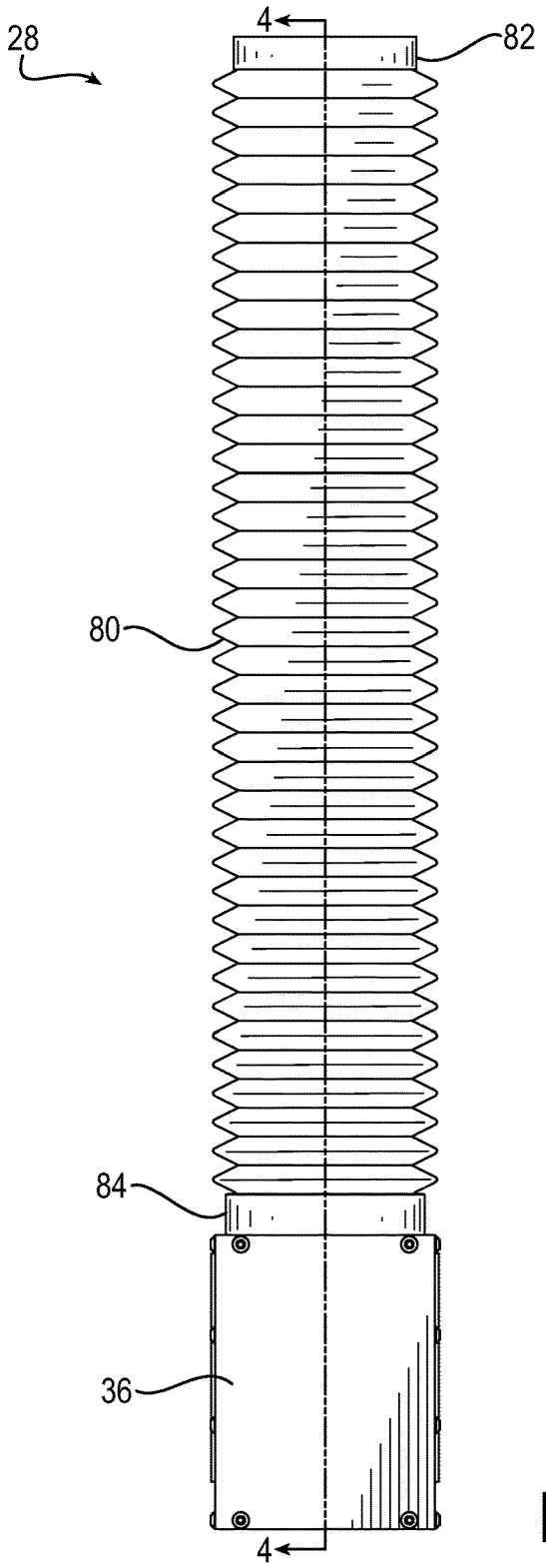
FIG. 3 is side elevational view of an exemplary multi-stage telescoping screw actuator mechanism according to the invention, with the actuator mechanism shown in an extended condition.
Figure 4:
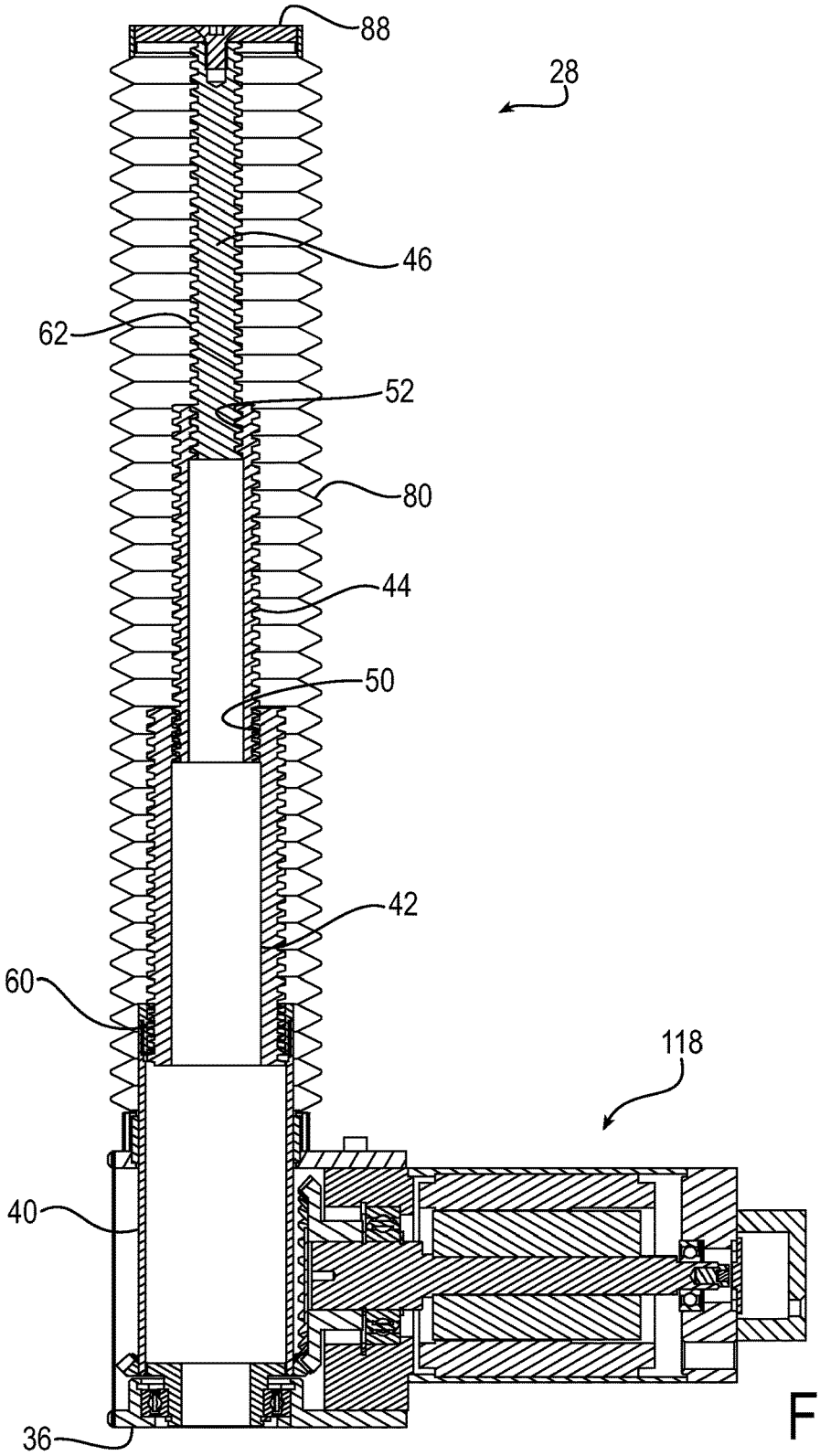
FIG. 4 is a cross-sectional view of the actuator mechanism of FIG. 3, taken substantially along the line A-A of FIG. 3.
Figure 5:
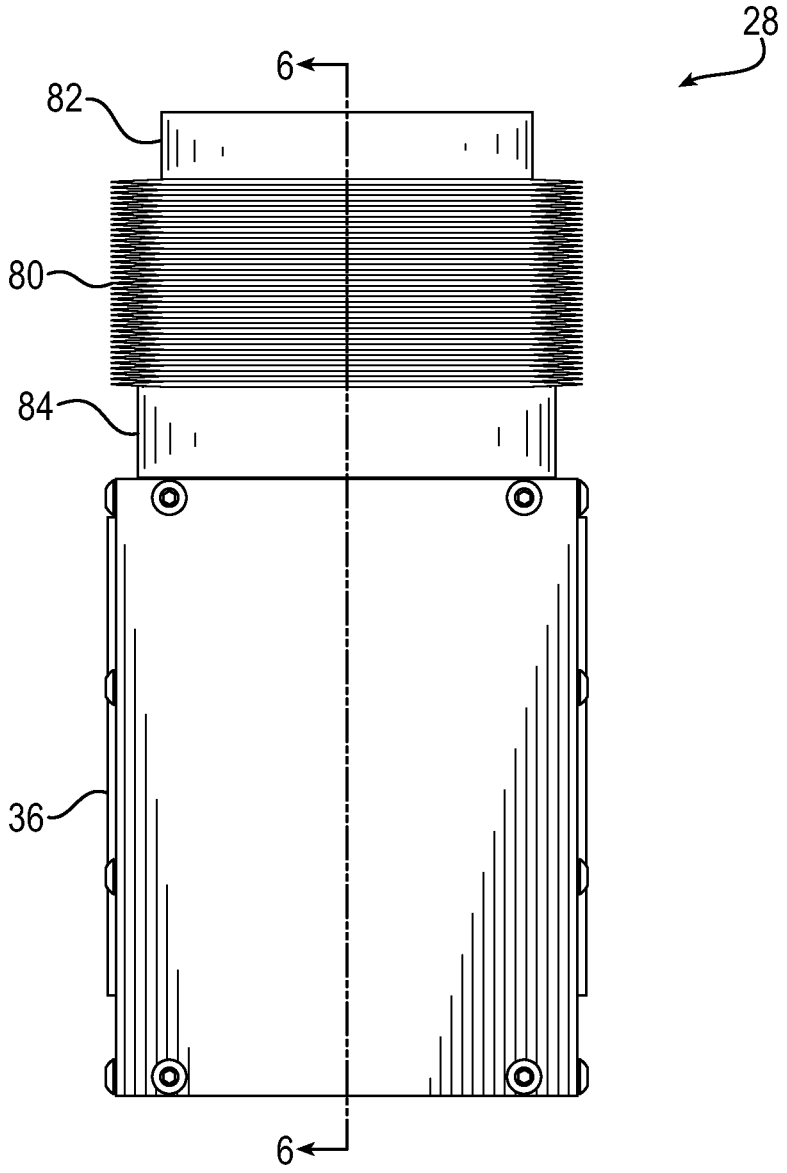
FIG. 5 is a side elevational view similar to FIG. 3, but showing the actuator mechanism in a retracted condition.

Referring now in detail to the drawings and initially to FIGS. 1 and 2, an exemplary window positioning apparatus for a vehicle according to the invention is indicated generally at 20. The window positioning apparatus generally comprises a window panel 22, a frame 24 in which the window panel is guided between a closed position closing a window opening 26 in the frame as seen in FIG. 1 and an open position opening the window opening as seen in FIG. 2, and a multi-stage telescoping screw actuator mechanism 28 connected between the window panel and the frame. The actuator mechanism is extendible to move the window panel from its open position to its closed position and collapsible (retractable) to move the window panel from its closed position to its open position.

In the illustrated embodiment, the frame 24 is a door frame of a vehicle, such as a military vehicle, which has vertical guide tracks 30 and 32 for the window panel 22. As shown, the actuator mechanism 28 can be accommodated in the small space below the bottom edge of the window panel 22 and the bottom of the door frame. Yet, the actuator mechanism, shown upright in FIGS. 1 and 2, can be extended many times its collapsed length (height) when comparing the extended condition of the actuator mechanism in FIG. 1 to the collapsed (retracted) condition of the actuator mechanism in FIG. 2. In its collapsed condition, the extendible portion of the actuator mechanism protrudes only a short distance beyond a stationary housing 36 of the actuator mechanism, such as less than one half the height of the housing 36. The housing 36 may be provided with mounting flanges or other suitable means for fixed attachment to the frame 24. If needed, the housing could be attached to the frame by a pivot connection to allow for pivotal movement of the housing about a horizontal axis or axes.

As is preferred, the distal end of the actuator mechanism 28 is connected to the window panel 22 by a connection 38 that can pivot about at least one pivot axis extending laterally (horizontally in FIGS. 1 and 2) with respect to the extension axis of the actuator mechanism which is vertically disposed in the frame 24. Most preferably the connection is a universal joint. If the window panel is a glass panel, then typically the glass panel would have fixed, at its lower edge, a metal or plastic attachment strip to which the connection 38 can be attached or which forms part of the connection.

Referring now to FIGS. 3-8, the multi-stage telescoping screw actuator mechanism 28 includes a plurality of screw members 40, 42, 44 and 46 of progressively decreasing diameter respectively telescopically disposed within a next adjacent screw member of larger diameter. The plurality of screw members includes a first stage screw member 40 that is rotatably supported and axially constrained in the housing 36, a last stage screw member 46 that can be attached to the window panel 22 as shown in FIGS. 1 and 2, and at least one intermediate stage screw member 42 and 44. In the illustrated embodiment, there are two intermediate stage screw members providing a four stage actuator mechanism. Fewer or additional stages may be provided.

Preferably, the first and intermediate stage screw members 40, 42 and 44 are tubes, preferably circular tubes, whereas the last stage screw member 46 could be a tube or a rod. Each intermediate stage screw member 42, 44 respectively has an internal thread 50, 52 and an external thread 54, 56. The external thread 54 of the intermediate (second stage) screw member 42 is engaged with an internal thread 60 of the first stage screw member 40. The internal thread 50 of the second stage screw member 42 is engaged with the external thread 56 of the intermediate (third stage) screw member 44. The internal thread 52 of the third stage screw member 44 is engaged with an external thread 62 of the last stage screw member 46. As will be appreciated, rotation of the first stage screw member in a first direction relative to the last stage screw member will cause the intermediate and last stage screw members to extend telescopically along an extension axis from the first stage screw member and rotation in a second direction opposite the first direction will cause the intermediate and last stage screw members to telescopically retract.

The external threads 54, 56 and 62 of the intermediate and last stage screw members 42, 44 and 46 each preferably extend essentially the entire length of the respective screw member. The internal threads 60, 50 and 52 of the first and intermediate stage screw members 40, 42 and 44 each may extend the length of the respective screw member, but preferably extend only partway from the distal end of the respective screw member as shown. For instance, the internal thread of each screw member may extend less than one quarter the length of the screw member.

Figure 6:
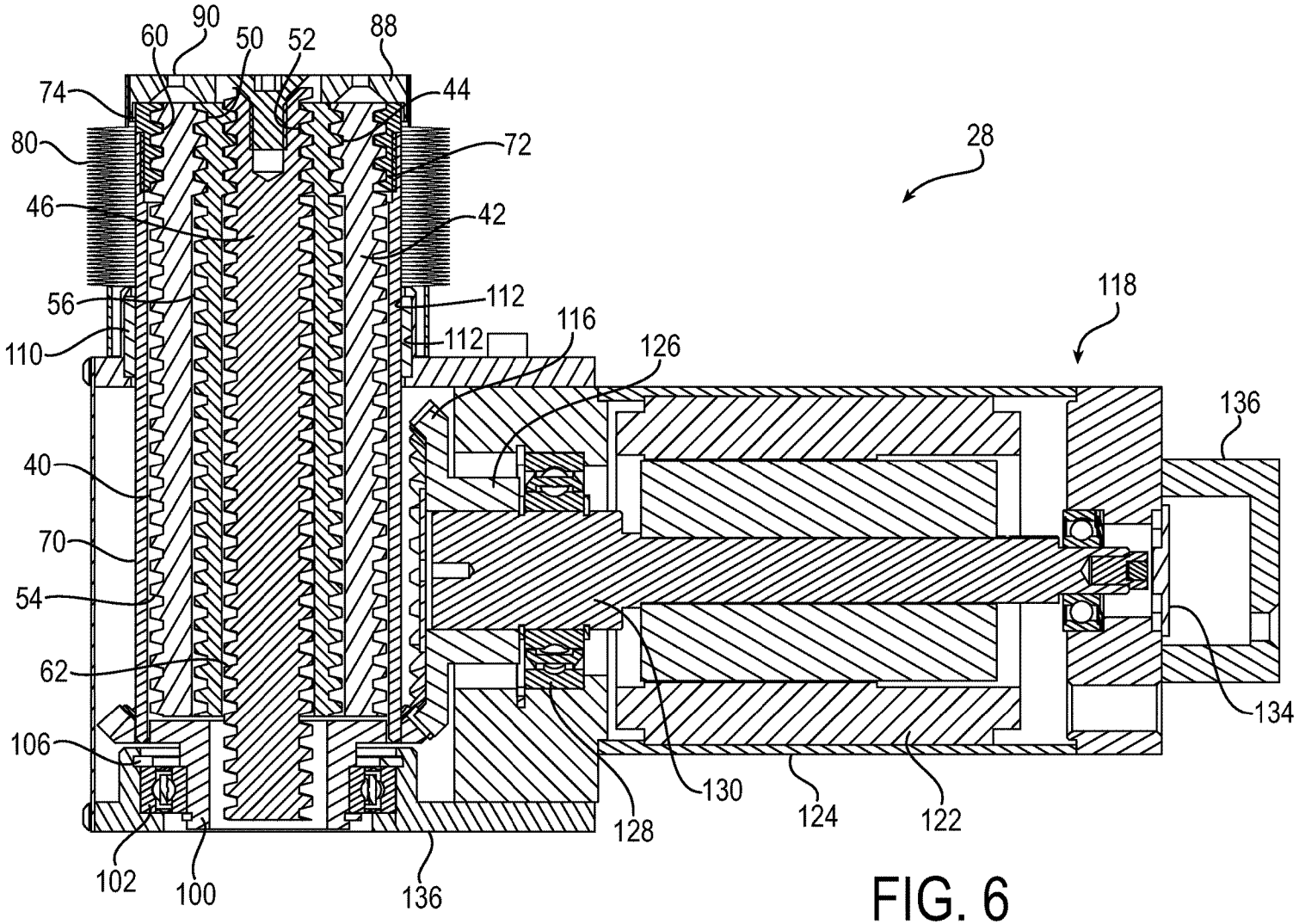
FIG. 6 is a cross-sectional view of the actuator mechanism, taken substantially along the line A-A of FIG. 5.
Figure 7:
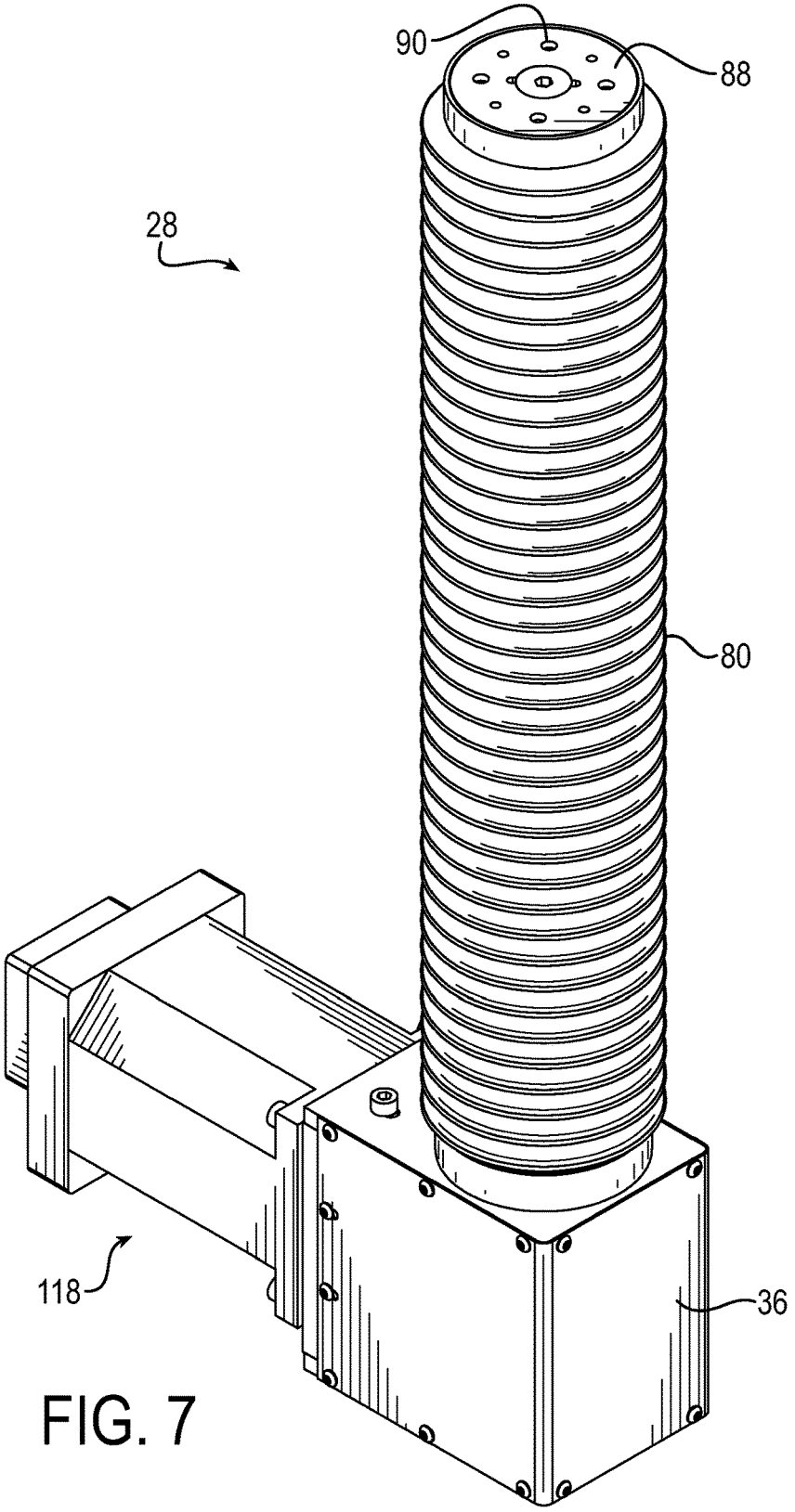
FIG. 7 is an isometric view of the actuator mechanism, shown in an extended condition.
Figure 8:
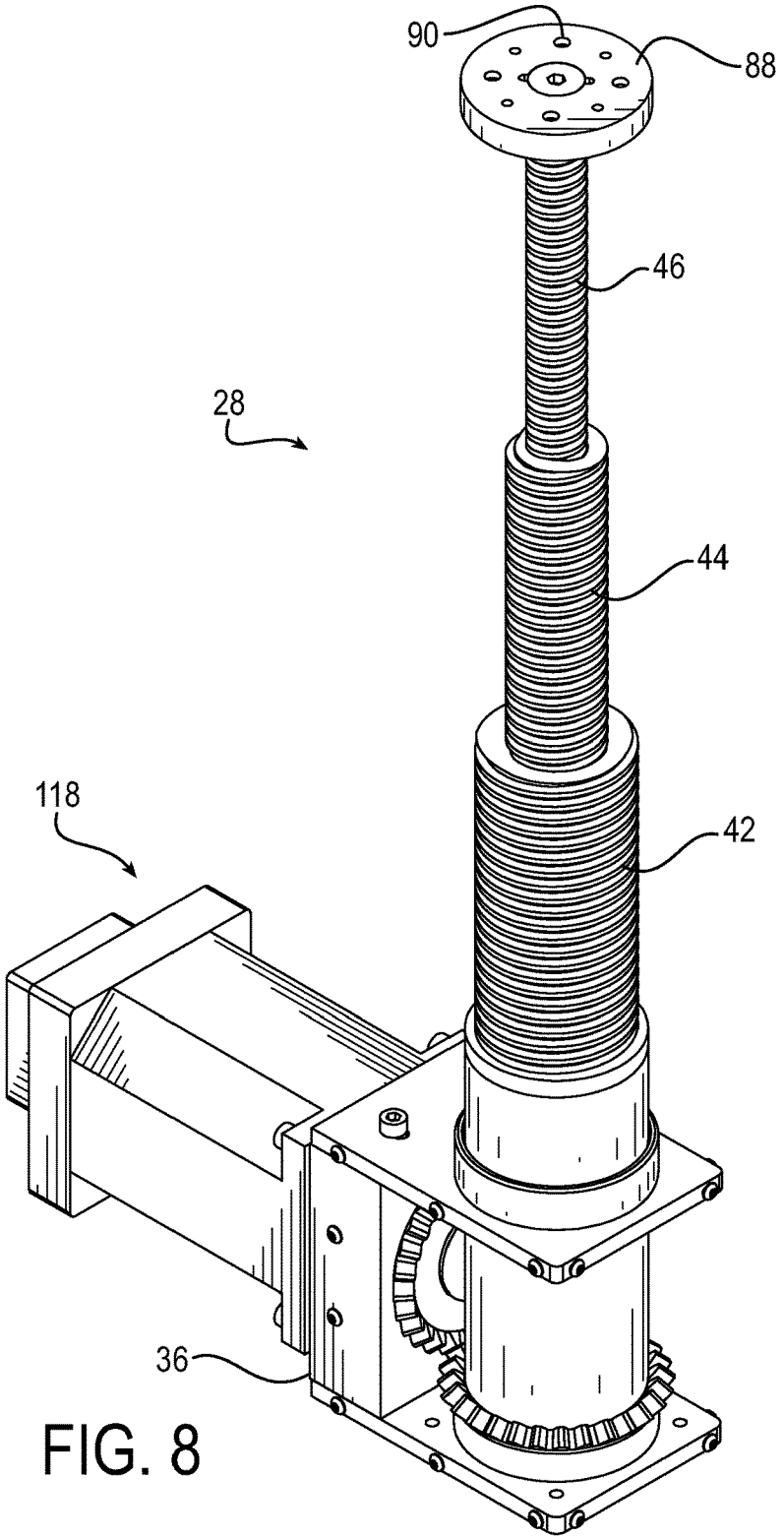
FIG. 8 is an isometric view of the actuator mechanism, with the bellows removed to show the several stages of the actuator mechanism in an extended condition.

More particularly and as best seen in FIG. 6, the first stage screw member 40 may have a cylindrical tube wall 70 provided with a counterbore 72 at the distal end of the first stage screw member for receiving a tubular insert 74 on which the internal thread 60 of the first stage screw member is formed. The tubular insert 74 may be formed of a material, in particular bronze, that is more lubricious than the material, in particular steel, from which the tube wall 70 is formed. The intermediate stage screw members may include tube walls and tubular inserts in the same manner, if desired.

The telescoping screw members may be protected from environmental conditions such as dirt and dust by an expandable and collapsible tubular shield 80 that surrounds the telescoping screw members. A preferred shield is a bellows, although other types of shields could be used such as a plurality of telescoping tubes that may be sealed with respect to one another. The shield or more particularly the bellows 80 may have one axial end attached, preferably by a clamp 82, to a distal end of the last stage screw member 46 and an opposite axial end attached, preferably by a clamp 84, to a distal end of the first stage screw member 40.

In order to effect extension and retraction of the actuator mechanism, the last stage screw member 46 should be fixed against rotation about the extension axis of the actuator mechanism.

In the illustrated embodiment, the last stage screw member 46 is keyed to an attachment plate 88 that can be used to connect the distal end of the last stage screw member to the window panel 22 as illustrated in FIGS. 1 and 2. The attachment plate may have, for example, one or more holes 90 for fasteners used to attach the attachment plate directly or via the connection 38 to the window panel against rotation about the extension axis.

Figure 10:
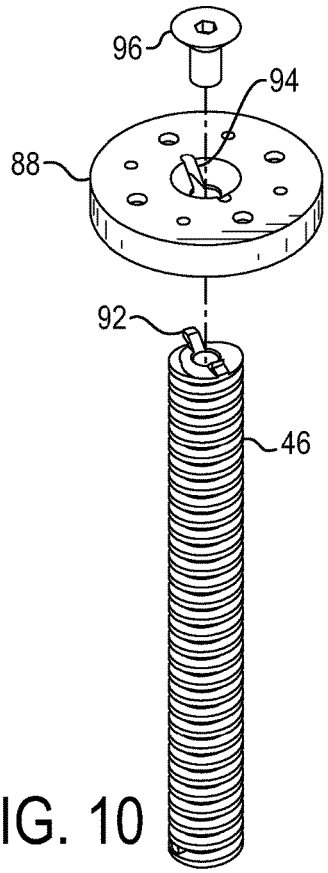
FIG. 10 is an exploded isometric view of a last stage screw member and mounting plate.

With reference to FIG. 10, the distal end of the last stage screw member 46 may be provided with an axially protruding key 92 that fits in a key slot 94 in the attachment plate 88 to prevent the last stage screw member from rotating relative to the attachment plate. A screw 96 may be used to secure the attachment plate to the end of the last stage screw member.

Figure 9:
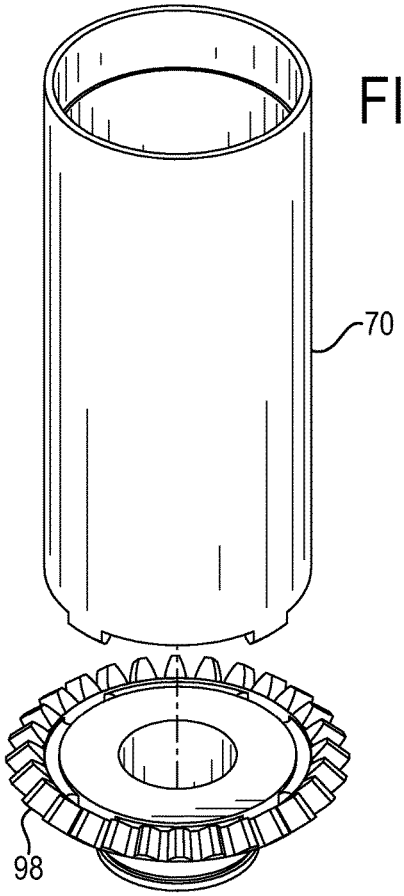
FIG. 9 is an exploded isometric view showing components of a first stage screw member.

As best seen in FIG. 9, the tube wall 70 of the first stage screw member 40 has affixed thereto and forming part thereof a driven gear 98. As shown the bottom of the tube wall has a plurality of tabs that are fixed in corresponding slots in the driven gear.

The driven gear 98, and thus the first stage screw member 40, has a downwardly protruding hub 100 that preferably is supported both radially and axially by a bearing 102 in the housing 36. A preferred bearing is the illustrated radial and/or thrust ball bearing. The bearing 102 at the proximal end of the first stage screw member is retained in a pocket formed in the bottom wall of the housing by a retainer clip 106. The first stage screw is also radially supported toward its distal end by a bearing 110 located in a counterbore in the housing through which the first stage screw member extends at the top of the housing 36. The bearing preferably is a bushing, which may be a split ring bushing. To install the bushing, the bushing may be radially contracted so that it can be inserted past a radially inwardly protruding lip 112 at the distal end of the counterbore and then released so that it will expand into the counterbore and be retained axially in place in the top wall of the housing by the retaining lip.

The driven gear 98 is engaged by a drive gear 116 of a drive 118. The driven and drive gears preferably are bevel gears so that the rotational axis of the drive gear can be disposed at right angle to the rotational axis of the driven gear so that the drive can extend at right angles to the extension axis of the actuator mechanism. In addition, the drive can be positioned such that the height thereof is within the height profile of the housing 36 to provide a vertically compact configuration.

As best seen in FIG. 6, the drive 118 may be a motorized drive including an electric motor 122 which may be a servo motor. The electric motor has a motor housing 124 that can be mounted in a tubular extension of the housing 36 and secured therein by suitable means. The drive shaft 130 of the motor may be secured in a socket in a hub 126 of the drive gear and may be radially supported by a bearing 128. At the outer end of the motor housing an encoder 134 may be provided to provide feedback to a controller that controls operation of the motor. The encoder may be enclosed by a cap 136 attached to the end of the motor housing.

Alternatively, the drive may be configured for manual operation. To this end, the motorized drive 118 can be replaced by a manual drive 140 including a hand crank 142 as seen in FIG. 15. The hand crank may be attached to the outer end of a drive shaft 144 that has the inner end thereof coupled to the drive gear 116, such as by the inner end of the drive shaft being secured in the socket in the hub of the drive gear in a manner similar to that shown in FIG. 6. If a hand crank is employed in a vehicle door like that shown in FIGS. 1 and 2, typically the rotational axis of the hand crank would be oriented at right angle to the plane of the door so that the crank can be operated in a manner similar to conventional hand crank window operators. If needed, the hand crank can be located at a position offset from the housing 36 and coupled to the driven gear via a chain or belt drive mechanism or even a gear train.

As a further alternative, the actuator mechanism may be provided with both a manual drive and a motor-driven drive.

Figure 11:
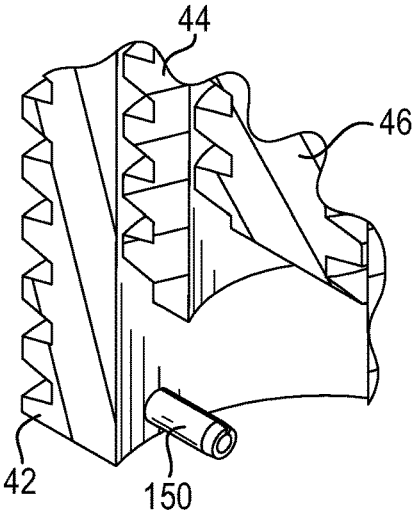
FIG. 11 is a fragmentary isometric view partly broken away in cross-section, illustrating an exemplary stop for preventing over-travel of a screw member.
Figure 12:
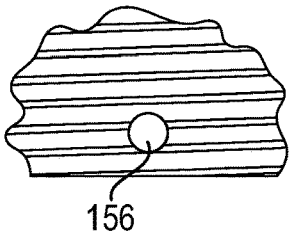
FIG. 12 is a fragmentary elevational view showing another stop for a screw member.
Figure 13:
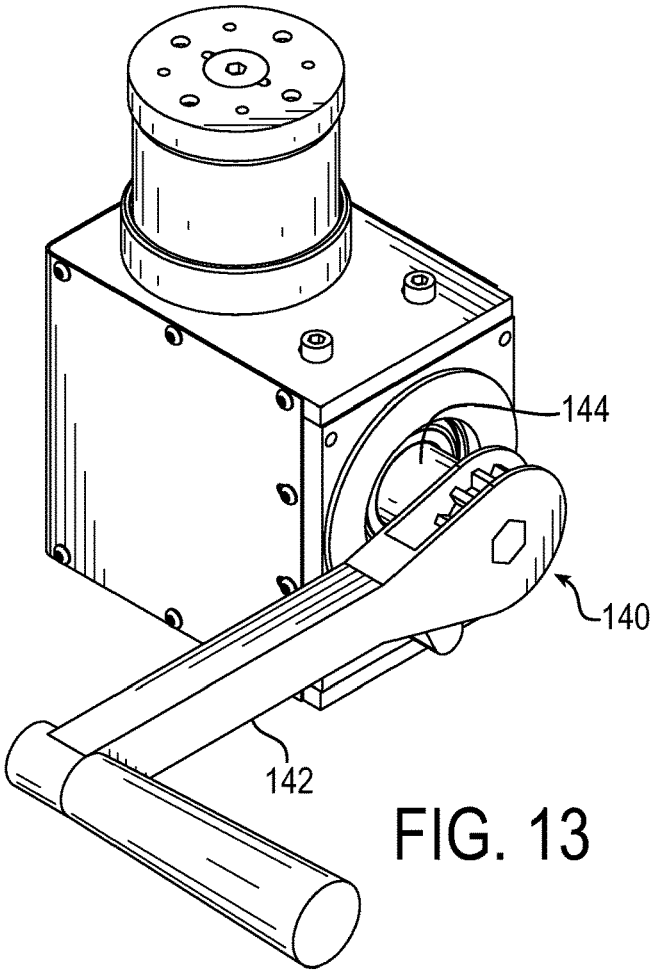
FIG. 13 is an isometric view of another embodiment of actuator mechanism including a hand crank in place of an electric motor.

As above mentioned, rotation of the first stage screw member 40, either by the manual drive or motorized drive, will effect extension and retraction of the telescoping screw members. In order to prevent a screw member from being unscrewed from an adjacent screw member and to ensure that rotational movement of the first stage screw member is transferred through the intermediate screw members, stops are provided to limit the extension and/or retraction of one screw member relative to an adjacent screw member. Any suitable stop may be used for this purpose. In FIG. 11, one such stop is formed by a pin 150 that extends radially inwardly from the proximal end of the second stage screw member for limiting the extent to which the third stage screw member can be retracted into the second stage screw member. FIG. 12 shows another stop formed by a pin 156 that protrudes into the thread of a screw member such that it will preclude the adjacent screw member from over-retraction or over-extension. For instance, such a stop (or other form of interference) can be provided at the proximal end of the external thread of the last stage screw member. As the last stage screw member is being screwed out of the third stage screw member, the stop at the proximal end of the last stage screw member will engage the proximal end of the internal thread of the third stage screw member, and this will prevent any further unscrewing rotation of the third stage screw member relative to the last stage screw member. If the third stage screw member has not been fully extended relative to the second stage screw member, rotation of the second stage screw member will result in unscrewing of the third stage screw member until a thread stop at the proximal end of the internal thread of the third stage screw member engages the proximal end of the internal thread of the second stage screw member. A similar arrangement can be provided between the second stage screw member and the first stage screw member. As for preventing over retraction, the aforesaid pins are provided for each stage, although this can be eliminated for the first stage since the second stage screw member can simply bottom against the top of the driven gear. Also, the support plate can be used as a stop since it can bottom out atop the first stage screw member.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

The invention claimed is:

1. A window positioning apparatus for a vehicle comprising:

a window panel, a frame in which the window panel is guided between a closed position closing a window opening in the frame and an open position opening the window opening, and a multi-stage telescoping screw actuator mechanism connected between the window panel and the frame, the actuator mechanism being extendible to move the window panel from its open position to its closed position and collapsible to move the window panel from its closed position to its open position, and wherein the multi-stage telescoping screw actuator mechanism includes a plurality of screw members of progressively decreasing diameter respectively telescopically disposed within a next adjacent screw member of larger diameter, wherein the plurality of screw members includes a first stage screw member that is rotatably supported and axially constrained in a housing fixed with respect to the frame, a last stage screw member attached to the window panel, and at least one intermediate stage screw member, and wherein each intermediate stage screw member has internal and external threads respectively for engaging external and internal threads on next adjacent screw members, such that rotation of the first stage screw member in a first direction relative to the last stage screw member will cause the intermediate and last stage screw members to extend telescopically along an extension axis from the first stage screw member and rotation in a second direction opposite the first direction will cause the intermediate and last stage screw members to telescopically retract.

2. The window positioning apparatus of claim 1, wherein the multi-stage telescoping screw actuator mechanism is located below the window panel and has the extension axis oriented upright within the frame.

3. The window positioning apparatus of claim 1, wherein the frame is a door frame and the window panel includes a glass panel.

4. The window positioning apparatus of claim 1, wherein the last stage screw member is fixed to the window panel against rotation about the extension axis.

5. The window positioning apparatus of claim 1, wherein the last stage screw member is connected to the window panel by a connection that can pivot about at least one pivot axis extending laterally with respect to the extension axis.

6. The window positioning apparatus of claim 5, wherein the connection is a universal joint.

7. The window positioning apparatus of claim 1, wherein the at least one intermediate stage screw member includes a plurality of intermediate stage screw members.

8. A multi-stage telescoping screw actuator mechanism for positioning a window in a vehicle comprising a plurality of screw members of progressively decreasing diameter respectively telescopically disposed within a next adjacent screw member of larger diameter, and a drive for rotating the first stage screw member, wherein the plurality of screw members includes a first stage screw member that is rotatably supported and axially constrained in a housing, a last stage screw member, and a plurality of intermediate stage screw members, and wherein each intermediate stage screw member has internal and external threads respectively for engaging external and internal threads on next adjacent screw members, such that rotation of the first stage screw member in a first direction relative to the last stage screw member will cause the intermediate and last stage screw members to extend telescopically along an extension axis from the first stage screw member and rotation in a second direction opposite the first direction will cause the intermediate and last stage screw members to telescopically retract, wherein the first stage screw member has a diameter greater than the intermediate and last stage screw members, and wherein the drive includes a driven gear attached to the first stage screw member, a drive gear engaged with the drive gear, and at least one of a motor or hand crank coupled to the drive gear for rotating the drive gear about an axis transverse to the extension axis.

9. The multi-stage telescoping screw actuator mechanism of claim 8, wherein the internal thread of each screw member extend less than one quarter the length of the screw member.

10. The multi-stage telescoping screw actuator mechanism of claim 9, wherein the first stage member is tubular and has a cylindrical tube wall provided with a counterbore at a distal end of the first stage member for receiving a tubular insert on which the internal thread of the first stage member is formed, and the tubular insert is formed of a material that is more lubricious than the material from which the tube wall is formed.

11. The multi-stage telescoping screw actuator mechanism of claim 10, wherein the material of the tubular insert is bronze and the material of the tube wall is steel.

12. The multi-stage telescoping screw actuator mechanism of claim 8, wherein the drive gear has a hub including a socket for receiving either a drive shaft coupled to a motor or a drive shaft coupled to a hand crank.

13. The multi-stage telescoping screw actuator mechanism of claim 8, further comprising an expandable and collapsible tubular shield surrounding the plurality of screw members.

14. The multi-stage telescoping screw actuator mechanism of claim 13, wherein the shield has one axial end attached to a distal end of the last stage screw member and an opposite axial end attached to a distal end of the first stage screw member.

15. The multi-stage telescoping screw actuator mechanism of claim 13, wherein the expandable and collapsible tubular shield is a bellows.

16. The multi-stage telescoping screw actuator mechanism of claim 8, wherein the first stage screw member is supported both radially and axially by a bearing in the housing.

17. The multi-stage telescoping screw actuator mechanism of claim 16, wherein the bearing is located at a proximal end of the first stage screw member, and a second bearing is located in the housing at a distal end of the first stage screw member.

18. The multi-stage telescoping screw actuator mechanism of claim 17, wherein the bearing located at the proximal end of the first stage screw member is a radial ball bearing and the second bearing is a bushing.

19. The multi-stage telescoping screw actuator mechanism of claim 8, further comprising a mounting plate keyed against relative rotation to the end of the last stage screw member.

20. The multi-stage telescoping screw actuator mechanism of claim 8, wherein the drive has a drive shaft configured for connection to a hand crank.

* * * * *